US009849431B2

(12) United States Patent
Lewis et al.

(10) Patent No.: US 9,849,431 B2
(45) Date of Patent: Dec. 26, 2017

(54) SYSTEM AND METHOD FOR AUTOMATED PRODUCTION, APPLICATION AND EVALUATION OF COATING COMPOSITIONS

(75) Inventors: Mark D. Lewis, Fairview Park, OH (US); Walter J. Robertson, Pittsburgh, PA (US); Mary Kimbro, Strongsville, OH (US); Nathan Goodnow, Harmony, PA (US)

(73) Assignee: PPG industries Ohio, Inc., Cleveland, OH (US)

( * ) Notice: Subject to any disclaimer, the term of this patent is extended or adjusted under 35 U.S.C. 154(b) by 0 days.

(21) Appl. No.: 13/548,524

(22) Filed: Jul. 13, 2012

(65) Prior Publication Data

US 2014/0017392 A1 Jan. 16, 2014

(51) Int. Cl.

| | |
|---|---|
| ***B01F 13/10*** | (2006.01) |
| ***B05C 9/14*** | (2006.01) |
| ***B05D 5/00*** | (2006.01) |
| *B05D 5/06* | (2006.01) |
| *B05C 11/10* | (2006.01) |

(52) U.S. Cl.

CPC ..... *B01F 13/1066* (2013.01); *B01F 13/1072* (2013.01); *B05C 9/14* (2013.01); *B05D 5/00* (2013.01); *B05C 11/1005* (2013.01); *B05D 5/06* (2013.01)

(58) Field of Classification Search

None

See application file for complete search history.

(56) References Cited

U.S. PATENT DOCUMENTS

| | | | | |
|---|---|---|---|---|
| 3,674,205 | A | 7/1972 | Kock | |
| 4,231,392 | A | 11/1980 | Allibert | |
| 4,390,126 | A | 6/1983 | Buchholz et al. | |
| 4,526,191 | A | 7/1985 | Pomponi, Jr. | |
| 4,627,465 | A | 12/1986 | Kolibas et al. | |
| 4,705,083 | A | 11/1987 | Rossetti | |
| 5,078,302 | A | 1/1992 | Hellenberg | |
| 5,080,285 | A | 1/1992 | Toth | |
| 5,083,591 | A | 1/1992 | Edwards et al. | |
| 5,184,051 | A | 2/1993 | Schweiker et al. | |
| 5,668,633 | A * | 9/1997 | Cheetam et al. | 356/402 |
| 5,851,583 | A | 12/1998 | Kronenwetter | |
| 7,250,464 | B2 | 7/2007 | Friel et al. | |
| 7,367,473 | B2 | 5/2008 | Meschiari | |
| 7,612,129 | B2 | 11/2009 | Friel et al. | |
| 7,698,021 | B2 | 4/2010 | Hughes et al. | |

(Continued)

FOREIGN PATENT DOCUMENTS

| | | |
|---|---|---|
| EP | 0846500 A2 | 6/1998 |
| EP | 1802386 B1 | 8/2011 |

(Continued)

*Primary Examiner* — Erma Cameron

(74) *Attorney, Agent, or Firm* — Alan G. Towner

(57) ABSTRACT

Systems and methods for producing, applying and evaluating coating compositions are disclosed. The amounts of components contained in the coating compositions may be monitored, along with processing parameters when the coating compositions are applied to various substrates. In certain embodiments, the characteristics of a produced sample coating are compared with the characteristics of a target or reference coating to determine if they are sufficiently matched.

12 Claims, 5 Drawing Sheets

(56) References Cited

U.S. PATENT DOCUMENTS

| | | | | |
|---|---|---|---|---|
| 7,793,676 | B2 | 9/2010 | Albrecht et al. | |
| 2002/0138211 | A1* | 9/2002 | Spitzer et al. | 702/30 |
| 2003/0163262 | A1* | 8/2003 | Corrigan et al. | 702/32 |
| 2004/0162641 | A1* | 8/2004 | Suzuki et al. | 700/265 |
| 2004/0250873 | A1 | 12/2004 | Taylor et al. | |
| 2004/0252308 | A1* | 12/2004 | Prakash et al. | 356/445 |
| 2006/0087914 | A1 | 4/2006 | Eckart, Jr. | |
| 2006/0181707 | A1* | 8/2006 | Gibson et al. | 356/402 |
| 2008/0235224 | A1* | 9/2008 | Joseph Rodrigues et al. | 707/6 |
| 2008/0262652 | A1 | 10/2008 | Eriksson | |
| 2008/0305241 | A1 | 12/2008 | Trevino, III et al. | |
| 2008/0305357 | A1* | 12/2008 | Munro et al. | 428/687 |
| 2009/0074947 | A1* | 3/2009 | Takeuchi | 427/8 |
| 2009/0074979 | A1 | 3/2009 | Krogedal et al. | |
| 2009/0099695 | A1 | 4/2009 | Trevino, III et al. | |
| 2009/0112371 | A1 | 4/2009 | Hughes et al. | |
| 2009/0204260 | A1 | 8/2009 | Bryne et al. | |
| 2009/0228143 | A1 | 9/2009 | Hughes et al. | |
| 2009/0228367 | A1 | 9/2009 | Hughes et al. | |
| 2009/0240363 | A1 | 9/2009 | Hughes et al. | |
| 2009/0242583 | A1 | 10/2009 | Elberson | |
| 2010/0030381 | A1 | 2/2010 | Clifford et al. | |
| 2010/0161141 | A1 | 6/2010 | Herre et al. | |
| 2012/0057224 | A1* | 3/2012 | Story et al. | 359/359 |
| 2012/0285984 | A1 | 11/2012 | Robertson et al. | |
| 2013/0156957 | A1 | 6/2013 | Lewis | |

FOREIGN PATENT DOCUMENTS

| | | | |
|---|---|---|---|
| JP | 2005290140 | | 10/2005 |
| WO | 0126788 | | 4/2001 |
| WO | 2008103405 | A1 | 8/2008 |
| WO | 2008150378 | A1 | 12/2008 |
| WO | 2010074813 | A1 | 7/2010 |
| WO | 2010091416 | A1 | 8/2010 |
| WO | 2010091418 | A1 | 8/2010 |

* cited by examiner

SYSTEM AND METHOD FOR AUTOMATED PRODUCTION, APPLICATION AND EVALUATION OF COATING COMPOSITIONS

FIELD OF THE INVENTION

The present invention relates to automated systems and methods for producing and applying coating compositions while monitoring their formulations and application parameters, and evaluating the resultant coatings and monitored data in comparison with target or reference coatings.

BACKGROUND OF THE INVENTION

Conventional color matching operations are very labor intensive. A technician typically hand-weighs a coating formula by selecting and manually pouring each component of the formula into a container on a scale, and reducing the formula by selecting a reducer and manually pouring the reducer into the component container using a measuring stick. The technician then mixes and applies the coating composition onto a panel. Each panel is visually assessed by an experienced colorist who adjusts the formula manually. The process then reverts back to the technician to re-weigh, spray and adjust until the match is considered acceptable by the colorist. This process tends to be error prone and inefficient, and can result in low-quality color matches.

SUMMARY OF THE INVENTION

An aspect of the invention provides a color matching method for coatings comprising: providing a target formulation for a coating composition including types and target amounts of components of the coating composition to be included in the target formulation; automatically dispensing the components of the coating composition into a container and measuring the amount of each of the components of the coating composition dispensed into the container; comparing the measured amount of each of the components with the target amount of each of the components; applying the coating composition to a substrate and curing the coating composition to form a sample coating; comparing characteristics of the sample coating with characteristics of a target coating produced from the target coating formulation; and correlating any differences between the characteristics of the sample coating and the target coating with the comparison between the measured amount of each of the components and the target amount of each of the components.

Another aspect of the invention provides an automatic color matching system comprising: at least one automatic coating component dispenser containing components of a coating composition; a container positionable adjacent to the at least one component dispenser to receive the components of the coating composition; a component sensor to measure the amounts of each of the components dispensed into the container; a mixer for mixing the components of the coating composition and the solvent; an automatic pressurization station structured and arranged to apply pressure to the mixed coating composition to thereby dispense the coating composition from the container to an application device; and a robotic arm structured and arranged to transport the container to the mixer after the components have been dispensed into the container and measured, and to transport the container from the mixer to the automatic pressurization station.

A coating composition dispensing system comprising: a computer programmed to provide a target formulation for a coating composition including types and amounts of components of the coating composition to be included in the target formulation; at least one automated component dispenser containing the components of the coating composition; a container positionable adjacent to the at least one component dispenser to receive the components of the coating composition; and an automated component sensor to measure the amounts of each of the components dispensed into the container, wherein the computer is programmed to store data corresponding to the measured amounts of each of the components.

DETAILED DESCRIPTION OF EMBODIMENTS OF THE INVENTION

As used herein, the term "color matching" means evaluation of the characteristics of a coating in comparison with another coating. The characteristics may include color or spectral characteristics, appearance, and physical properties. Color/spectral characteristics are known in the coatings art, and include solid colors and gonio apparent colors such as metallic and pearlescent colors. Such characteristics are often measured or analyzed in the visual range of the electromagnetic spectrum, but in some cases may be measured or analyzed in other ranges of the electromagnetic spectrum, such as infrared and ultraviolet ranges. Examples of appearance characteristics include gloss, haze, distinctiveness of image, mottling, transparency, and the like. Examples of physical characteristics include film thickness, drying time, hardness, abrasion resistance, adhesion, conductivity, density, dispersion, flexibility, and the like. As used herein, the term "target coating" means a coating having at least one characteristic that is to be matched in comparison with a coating produced in accordance with the present invention. As used herein, the term "target formulation" means a coating formulation corresponding to a selected coating that is identical or similar in characteristics to the target coating to be matched. The selected coating and corresponding target formulation may be selected manually and/or automatically, for example, by a color analyst comparing the target coating to multiple color chips and selecting at least one of the color chips that appear to match the target coating. The selected color chip may have an associated color formulation that becomes the "target formulation" during a color matching process. The term "sample coating" means a coating produced by the present system or method that may be evaluated in comparison with the target coating. The term "component", when referring to a coating composition, means a constituent or ingredient of the coating composition formulation, such as a pigment, tint, resin, additives, catalysts, solvents or the like.

Figure 1:
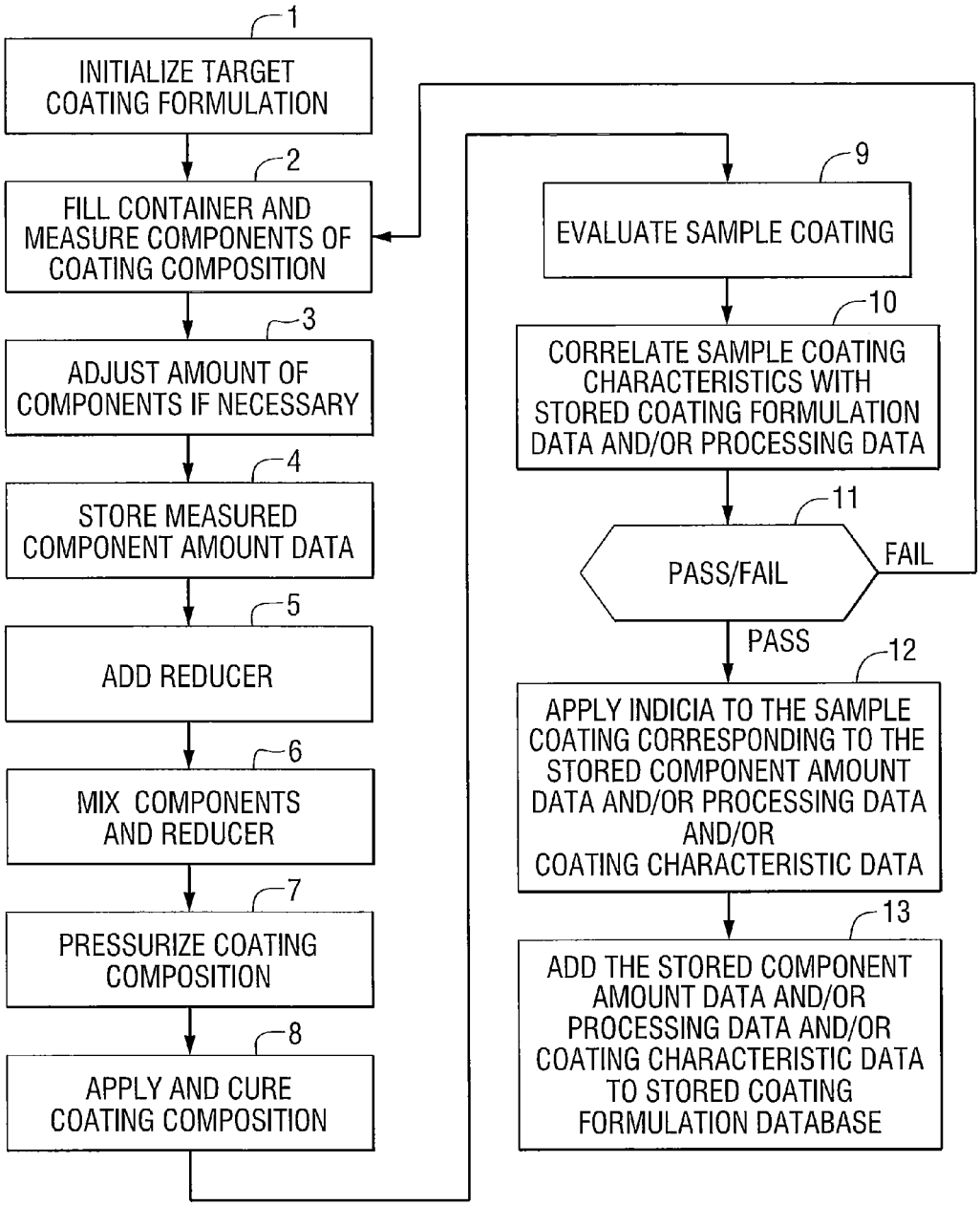
FIG. 1 is a flow diagram illustrating aspects of an automated coating system and method in accordance with an embodiment of the present invention.

FIG. 1 is a flowchart illustrating aspects of an automated coating system and method in accordance with an embodiment of the present invention. The steps include: 1 initialize target coating formulation; 2 fill container and measure components of coating composition; 3 adjust amount of components if necessary; 4 store measured component amount data; 5 add reducer; 6 mix components and reducer; 7 pressurize coating composition; 8 apply and cure coating composition; 9 evaluate sample coating; 10 correlate sample coating characteristics with stored coating formulation and/or processing data; 11 pass/fail analysis; 12 apply indicia to the sample coating corresponding to the stored coating component amount data and/or processing data and/or coating characteristic data; and 13 add the stored component amount data and/or processing data and/or coating characteristic data to a stored coating formulation database. The systems and methods of the present invention are suitable for use in many applications. Examples of some suitable applications include automotive refinish, automotive OEM, automotive parts and products, architectural coatings, consumer electronics, appliances, sports and recreation equipment, aerospace and the like. In certain embodiments, the coating compositions may be applied to one or more test panels such as those used in color laboratories and the like.

Any suitable coating compositions may be used in the system of the present invention. For example, some suitable solvent-based coating compositions include isocyanate hydroxyl, epoxy amine, anhydride hydroxyl, acrylate, acrylic/CAB, alkyd, acetylacetonate ketamine, acrylic lacquer, vinyl butylaldehyde, epoxy/acid, melamine hydroxyl, silane, acrylic urethane and the like. Some suitable water-based compositions include isocyanate hydroxyl, epoxy amine, acrylic latex, melamine hydroxyl, polyurethane dispersions and the like.

In the first step 1 illustrated in FIG. 1, a target coating formulation may be initialized by searching for a color in a file drawer that is similar to a target color, visually comparing that color to the target color, and then entering that target coating formulation into a computer file. In certain embodiments, a reflectance searching tool may be used to scan the target color, and then standard algorithms known to those skilled in the art may be used to search an electronic database of pre-established formulations in the same coating chemistry and list colors that are deemed close by the algorithms. Next, the operator may visually compare the close colors to the target color, and enter the closest target coating formulation into a computer file. Alternatively, reflectance properties of the target color may be entered, and algorithms known to those skilled in the art may attempt a new formulation of components that will be a starting point for the color match.

In the next step 2 shown in FIG. 1, a container is delivered to at least one dispensing station where components of the selected coating composition formulation are put into the container. At this stage, the amount of each component added to the container is measured by any suitable means. For example, the weight of each component may be measured by a scale. Each ingredient is dispensed as close as possible to the target amount. However, since the dispensers may not achieve 100 percent exact dispenses, the actual dispensed weight is recorded to provide a true composition of the color being mixed. For example, if a dispense of 100.2 g of a component is called for, the actual dispensed amount may actually be 100.3 g. This may be due to the viscosities of the coating components, as well as a certain amount of imprecision by the dispensers. Thus, a close but not always exact dispense will result. Both the target and the as-poured weight amounts may be stored, and the actual as-poured weight amounts are utilized as the true representation of the color.

In the next step 3 shown in FIG. 1, based on the measured values of the individual components, the system may optionally adjust the formulation, for example, by adding an additional amount of at least one of the components if it is determined that the amount of that component is below the level of the target formulation in relation to the other components.

In the next step 4 shown in FIG. 1, the measured amount of each component, along with the measured amount of the reducer, may be stored in a computer or other data storage device or system.

After the components of the coating composition are dispensed, measured and their amounts stored, a reducer may optionally be added to the container in step 5 shown in FIG. 1. Any suitable reducer may be used, including water and organic solvents known to those skilled in the coatings art. The amount of reducer added may be measured, for example, by a scale or a volumetric metering device. The measured amount of reducer may also be stored along with the measured component amount data.

In the next step 6 shown in FIG. 1, the various components and reducer of the coating composition are mixed, e.g., using an automated mixing system, as described more fully below.

After the coating composition is mixed, the container may be transported to a system where the coating composition is automatically pressurized 7, as more fully described below.

Once pressurized, the coating composition may be applied to various types of substrates and cured in step 8 to form a coated article or sample coating, as more fully described below.

In the next step 9 shown in FIG. 1, the resultant sample coating is evaluated by visual and/or automated detectors. Examples of manual evaluation techniques include side-by-side and/or overlay comparisons of a target coating versus the sample coating product by the present process. The evaluations may be performed in standard viewing conditions, including simulated daylight, horizon light, fluorescent light, UV light and intense simulated daylight spotlights for color depth. In certain embodiments, the assessments are performed in conditions that are devoid of ambient light penetration so that the assessor can judge the color in the specified conditions. Automated evaluation techniques include, for example, a spectral and appearance analysis of the target coating color as compared to the sample coating color. A spectral curve or images may be generated from various viewing angles and various light sources, along with a numerical tolerance value that indicates the relative proximity of the two panels in color space. In addition to providing an indication of distance or closeness to the target coating color, the system may additionally be used to indicate the types and amounts of components to add, remove or alter in an attempt to get a color match.

As shown in step 10 of FIG. 1, after the sample coatings are evaluated, their characteristics may be stored and may be correlated with the previously stored data including the target coating formulation, the actual measured coating formulation including the respective amounts of each component, and application parameters such as pressure level, delivery rate, substrate type, spray pattern overlap, number of coating layers, number of coating compositions, flash and curing times, etc.

In the pass/fail step 11 shown in FIG. 1, selected characteristics of the sample coating, as measured or otherwise analyzed by the manual and/or automated processes described above, may be compared to the characteristics of the target coating to determine whether there is an acceptable match. If the sample coating passes, the process may proceed to steps 12 and 13 described below. If the sample coating fails, the process may proceed back to at least one of the earlier steps, such as step 2 shown in FIG. 1, where adjustments may be made manually or automatically in order to obtain a closer match. For example, in step 2, a new container may be filled with measured amounts of the coating composition components, and the process may proceed again as shown in FIG. 1.

In the next step 12 shown in FIG. 1, indicia may be applied to the sample coating, for example, by applying alpha-numeric symbols, bar codes, quick response codes or any other type of indicia to a panel comprising the sample coating. For example, a back or front portion of a panel may be directly marked, or a label may be affixed thereto. The indicia may contain data such as the component amount data, the processing data, the coating characteristic data including color/spectral data, appearance data and/or physical property data, pass/fail data and/or data corresponding to how closely the characteristics of the sample coating match the characteristics of the target coating.

In the last step 13 shown in FIG. 1, the various types of data described above may be added to a database, such as the database containing the stored coating formulations. While this step, and other steps shown in FIG. 1, are illustrated sequentially, it is to be understood that the steps may be performed in any suitable order and may be performed in parallel as well as sequentially.

Figure 2:
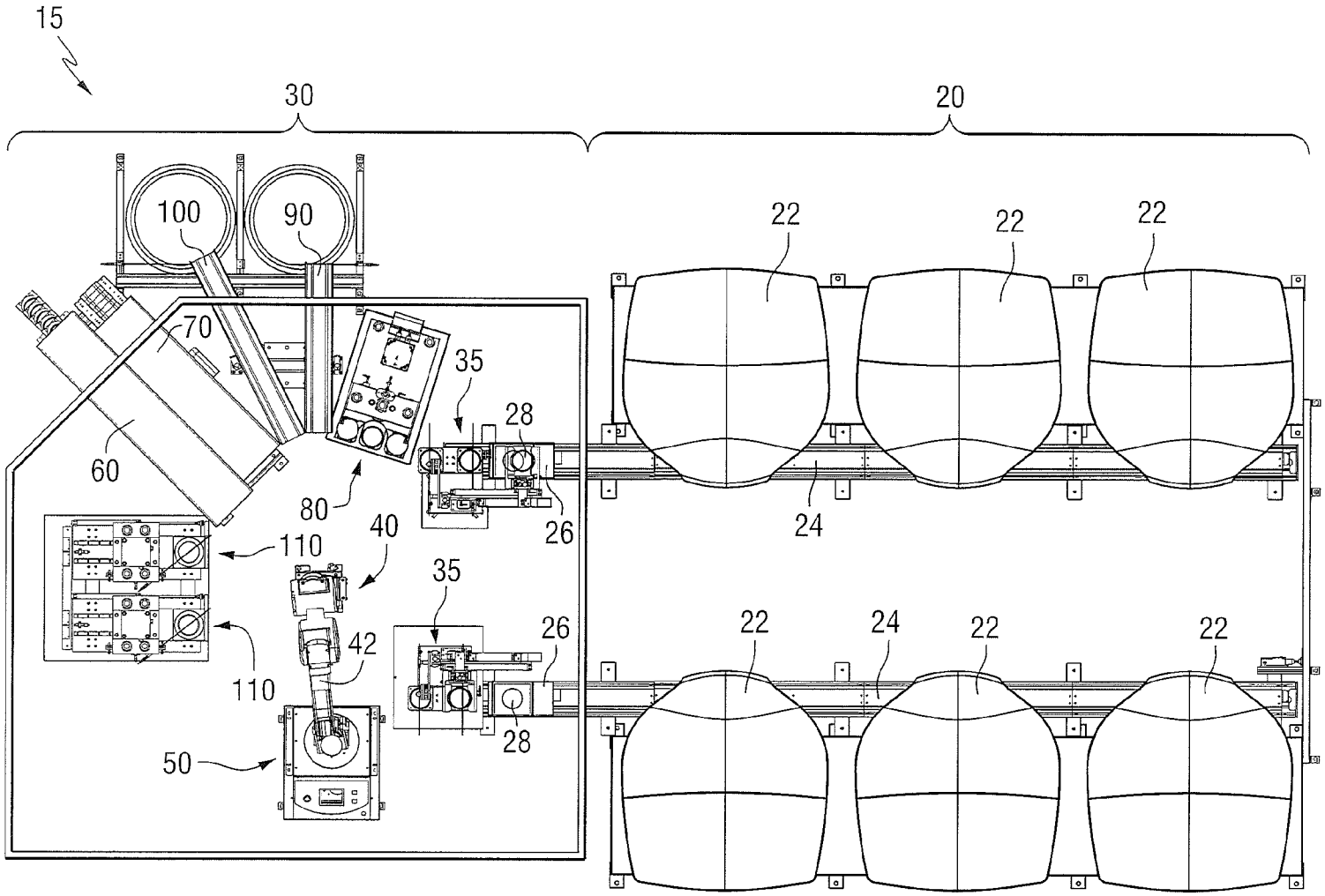
FIG. 2 is a plan view illustrating aspects of an automated coating system in accordance with an embodiment of the present invention.

FIG. 2 illustrates an automatic coating system 15 in accordance with an embodiment of the present invention. The automatic coating system 15 includes an automatic coating dispensing system 20 and an automatic coating composition mixing and pressurization system 30.

Figure 3:
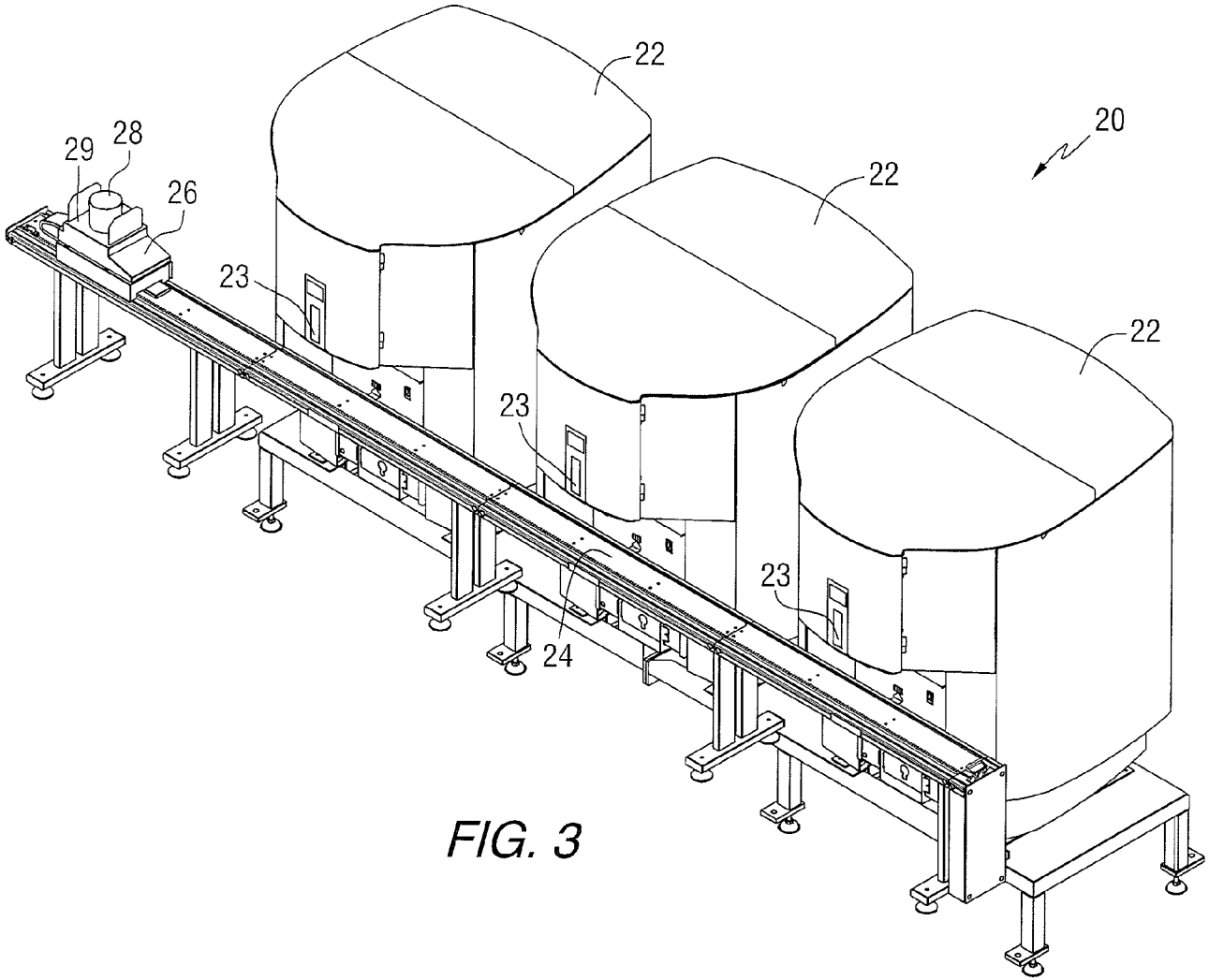
FIG. 3 is an isometric view of an automatic coating composition dispensing system in accordance with an embodiment of the present invention.

As shown in detail in FIG. 3, the automatic coating dispensing system 20 includes multiple coating component dispensers 22 in which components of coating compositions are stored and dispensed through coating nozzles 23. A conveyer 24 adjacent to the coating component dispensers 22 carries a shuttle 26, which supports a container 28 into which the coating components are dispensed from at least one of the dispensers 22. The shuttle 26 includes a scale 29 that is used to measure the weight of each coating component as it is dispensed from one the dispensers 22. During an automatic dispensing operation, the shuttle 26 travels along the conveyor 24 to a location underneath a dispensing nozzle 23, where the cup 28 is filled with the particular coating component. After a coating component is dispensed into the container 28, the scale 29 is used to measure the weight of the component. After the shuttle 26 and container 28 have been transported to one or more of the dispensers 22, and the container 28 has been filled with the appropriate coating components, the shuttle 26 moves to a position as shown in FIG. 2 adjacent to a reducer dispenser 35. At this stage, in certain embodiments, the container 28 may be filled with a desired type and amount of reducer. Alternatively, the reduced may be dispensed into the container 28 by at least one of the dispensers 22.

Figure 4:
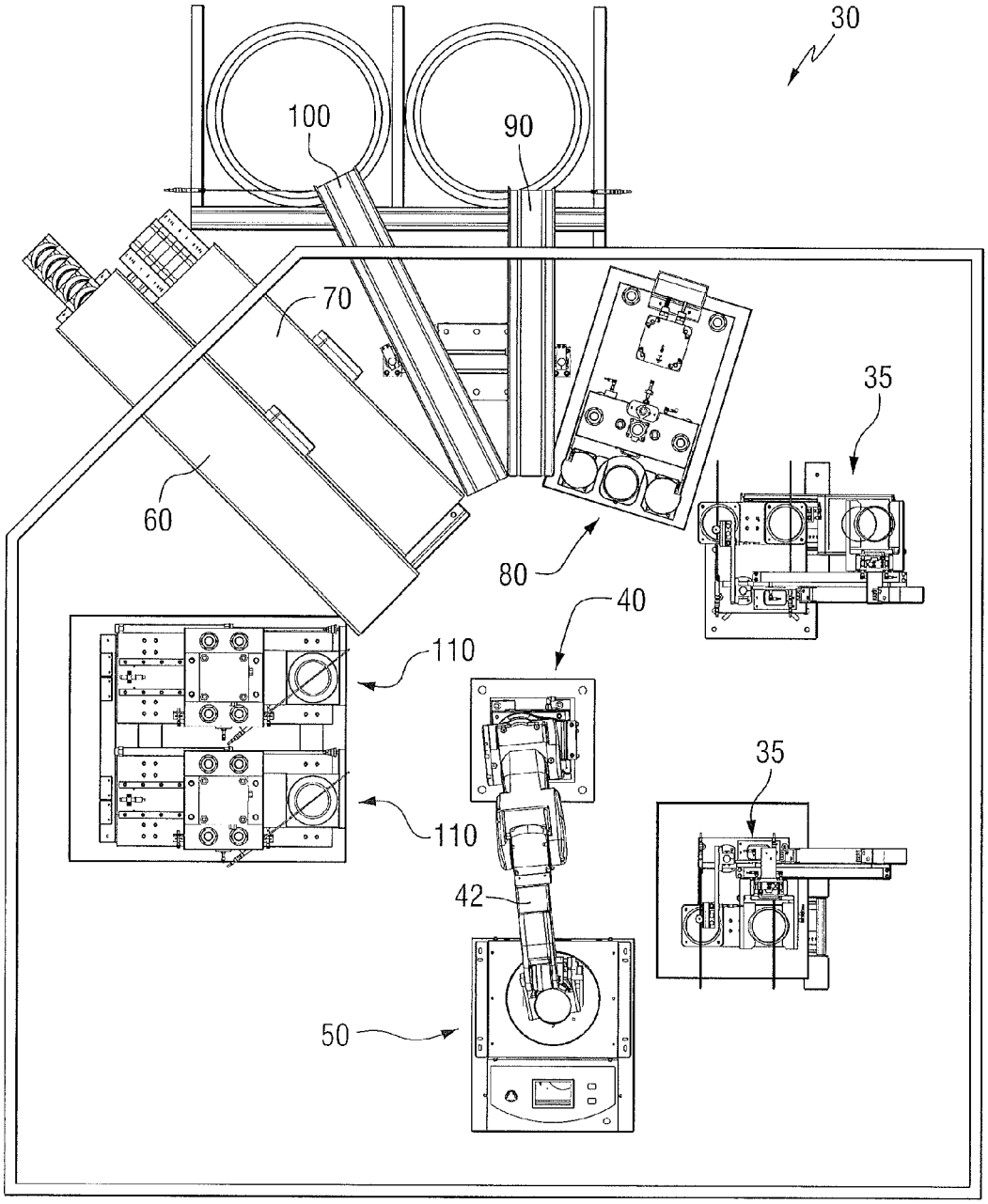
FIG. 4 is a plan view illustrating aspects of an automated coating system in accordance with an embodiment of the present invention.

As shown in FIGS. 2 and 4, the automatic coating composition mixing and pressurization system 30 includes reducer dispensers 35, a robot 40 with a robotic arm 42, and a mixer 50. The mixing and pressurization system 30 also includes a container supply assembly 60, a lid supply assembly 70, and a lid installation and removal assembly 80. The mixing and pressurization system 30 also includes a lid disposal chute and receptacle 90, and a container disposal chute and receptacle 100. The mixing and pressurization system 30 further includes pressurization systems 110.

The various components and assemblies shown in FIGS. 2 and 4 are arranged such that the robot arm 42 can efficiently move the coating composition container 28 to various stations of the mixing and pressurization system 30. After a dispense completion signal from the dispenser, a container 28 filled with the dispensed and measured coating components may be loaded to the reducer dispenser 35, where the desired reducer is dispensed into the container. The robot 40 then transfers the filled container 28 to the lid installation and removal assembly 80, where a lid is applied to the container 28. The robot 40 may transfer the capped container 28 to the mixer 50 to mix the components and reducer, e.g., for a pre-defined time of from 10 to 60 seconds or the like, for example, for 30 seconds. The robot 40 may then transfer the container 28 from the mixer 50 to the lid installation and removal assembly 80, where the lid is removed from the container 28 and dispensed into the lid disposal chute and receptacle 90. The robot 40 may then transfer the container 28 to the automated pressurized system 110. After the pressurization and application steps, the robot 40 may transfer the used container 28 to container disposal chute and receptacle 100. The disposed lids and containers may be discarded, or cleaned and recycled.

Figure 5:
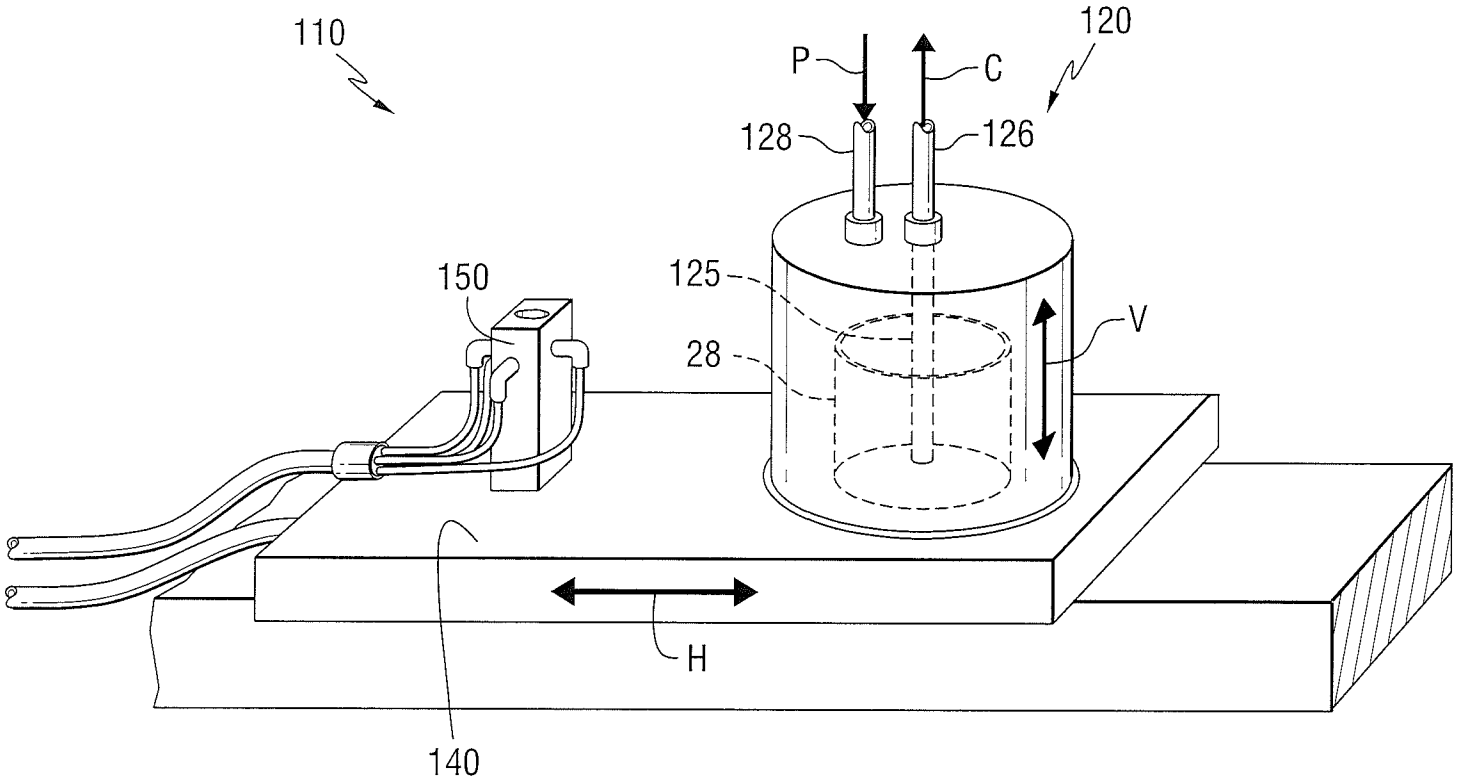
FIG. 5 is a partially schematic side view of a container pressurization system for use in an automated coating system in accordance with an embodiment of the present invention.

In certain embodiments, after the coating components and reducer have been mixed, the container 28 is transported to a pressure delivery system, such as disclosed in U.S. patent application Ser. No. 13/104,043, which is incorporated herein by reference. An embodiment of a pressure delivery system is schematically illustrated in FIG. 5. The pressure delivery system 110 includes a pressure canister 120. A filled coating composition container 28 is placed on a support base 140, and then moved in a horizontal direction H to a position under the pressure canister 120. The pressure canister 120 is lowered in a vertical direction V to form a seal against the support base 140. The pressure canister 120 is then pressurized and the coating composition is delivered from the pressure canister 120 to a selected application device (not shown). After the desired amount of coating composition has been delivered, the pressure canister 120 is raised in the vertical direction V, and then the support base 140 is moved in the horizontal direction H to its initial position.

The pressure delivery system has an initial staging position in which the fill container 28 is placed on the support base 140. The support base 140 is then moved horizontally H to a position where the container 28 is located below the raised pressure canister 120. The pressure canister 120 is then lowered to a position in which the pressure canister 120 contacts the support base 140.

When the pressure canister 120 is positioned as shown in FIG. 5, a pressurized gas P is introduced into the pressure canister 120 through a pressure line 128, the coating composition in the container 28 is forced upward through a stem 125 and through the delivery line 126 to provide a flow of the coating composition C to the desired application device (not shown).

As further shown in FIG. 5, a cleaning fixture 150 is mounted on the support base 140 at a different horizontal position than where the container 28 is supported. The cleaning fixture 150 includes a hollow cleaning chamber that is structured and arranged to receive the stem 125 of the pressure canister 120 when the system is in the cleaning position.

At any suitable time during the cycle, and preferably when the support base 140 is located in the initial position, the spent coating composition container 28 may be removed from the support base 140 and may be replaced with another filled container 28. In this manner, the containers 28 may be removed and replaced during a cleaning operation in order to increase the speed in which the system can deliver various types of coating compositions. Such removal and replacement may be done, in certain embodiments, automatically. For example, a robot arm 42 such as shown in FIGS. 2 and 4 may be used to remove spent coating composition containers 28 from the support base 140 and/or to place filled containers 28 on the support base 140. The use of a substantially flat support base 140 facilitates efficient placement and removal of the coating composition containers 28 because the containers 28 may be placed on the support base 140 by relatively simple movement in a horizontal plane rather than by more complex movement involving vertical placement of the containers down into a pressure canister having sidewalls. For example, the robot arm 42 may be rotated and/or translated in a substantially horizontal plane to place a container 28 on the support base 140 with little or no vertical movement required.

In certain embodiments, the coating composition may be applied to panels, cured and evaluated, for example, using a carrier system as disclosed in U.S. patent application Ser. No. 13/327,903, which is incorporated herein by reference. The steps of the process may include: mounting at least one panel on a carrier; applying a coating composition to the panel(s); transporting the carrier and panel(s) to a curing location; curing the coating composition; transporting the carrier and panel(s) from the curing position; and removing the panel(s) from the carrier. Before or after the removal step, the characteristics of the cured coating may be evaluated manually or automatically.

After the panels are mounted on the carrier, at least one coating composition as described above may be applied to the panels. The coating composition may be applied by any suitable method such as spraying, rolling, brushing, blade coating, spin coating and the like. The same or different coating composition may be applied to each of the multiple panels. Furthermore, each individual panel may have a single coating composition or multiple coating compositions applied thereto.

After the coating composition(s) are applied, the carrier and panels may be transported to a flash location and/or a curing location. The carriers with the affixed coated panels may be moved out of the sprayer or other application area, e.g., by a shuttle system utilizing a robotic arm that grasps the carrier and moves it to a slide mechanism or other support structure. The entire carrier may remain on the support structure for a specified flash time before the carrier is moved to a cure area.

After the curing operation, the carrier and panels may be removed and evaluated. For example, manual or automated measurements as described above may be made. In certain embodiments, quality control measurements may be made with a three-axis device which presents a painted panel surface to a spectrophotometer in a selected orientation and measurement map. For example, multiple measurements at different orientations may be made. Suitable types of spectrophotometers include sphere-based, multi-angle, single-angle and gonio spectrophotometers. Other types of devices for evaluating the panels include electronic microscopes, flatbed scanners, still film cameras, optical cameras, digital cameras, x-ray cameras, infrared cameras, analog video cameras, digital video cameras, gloss meters, film build gauges and the like.

In certain embodiments, when the measurements are completed, a robot arm may move each panel to an indicia labeling system where the panel will have desired indicia applied thereto. The labeled panels may then be stored, for example, by placing them in a rack to protect their coated surfaces. In an embodiment of the invention, an automated process may be provided which tracks a particular panel, its coating formulation, and associated reflectance or other characteristics, and uploads or otherwise stores such information in a database for various uses.

In certain embodiments, the systems and methods of the present invention may utilise various procedures as described below.

Input coating composition formulation: a specific job identification (ID) is created; a specific formula ID is created; a list of components and target weight amounts is created; user/assessor information is tied to the job ID; and job information is tied to the job ID.

Job types: number of dispenser systems, e.g., 1, 2, 3, 4; date/time stamp of job initiation; paint system; job ID; number of coats of base coat requested; number of panels required (e.g., 1 or 4); spectral gray panel color type; heated flash required (y/n) after first coat and timing; amount of reducer to be added based on job ID; specified mixing time; automated pressure container air pressure levels; clear coat required (y/n); clear coat process, e.g., number of coats, pressures, flash times, etc; cure oven timings for basecoat and clear coat operations; ambient air flash times between each stage of panel movement; QC measurement process; QC measurement data linked to job ID; and date/time stamp of job completion.

Data/reporting: number of jobs per dispenser/paint line per hour/day; down time or error incidents causing delayed production; dispense times per job; automation times by process from dispense start/stop, panel movement, application, job completion time, etc.; and date/time stamp of user inputs.

Coating application: during the coating application step, the carrier with panels mounted thereon may be transferred to the applicators and a job number may be called to commence spraying (example: paint type; number of panels=1; number of coats=3; heated flash after first coat only; and 60 second flash between coats). The applicator may then spray or otherwise apply the coating compositions onto the panels. In certain embodiments, after the base coat has been applied, the panel carrier may be presented to a heat box for flash cure so that it can be sprayed with additional coat(s), or it may be transferred to a cure oven for curing, and finally it may be presented to a clear coat applicator.

Evaluation: in the sample coating evaluation step, a robot or other transport device may transfer a panel or a carrier having at least one panel mounted thereon to a quality control (QC) unload station. A panel to be measured may be placed on a cooling plate for 60 seconds to cool down. At the unload QC area, a QC inspection head may be fixed and the panel may move to various positions to present the panel for measurements in pre-defined locations. Feedback may be managed to ensure a reading cycle was successful, in which case the measurement job may be completed. If the measurement is unsuccessful, the panel may be labeled accordingly and sorted, e.g., into a reject stack. If a measurement is successful, the readings may be added to the database.

Indicia application: the QC inspected panel may be presented to a label print and apply system where the final panel label will be printed and applied to the panel. After verification, the panels may be loaded into racks, cartridges or otherwise stored. Data resulting from the above steps may be transferred to a suitable computer database, such as the coating formulation database.

For purposes of this detailed description, it is to be understood that the invention may assume various alternative variations and step sequences, except where expressly specified to the contrary. Moreover, unless otherwise indicated, all numbers expressing quantities used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

We claim:

1. A color matching method for coatings comprising:

providing a target formulation for a coating composition including types and target amounts of components of the coating composition to be included in the target formulation;

automatically dispensing the types of the components of the target formulation into a container to provide a sample coating composition and automatically measuring the amount of each of the components of the sample coating composition dispensed into the container;

comparing the measured amount of each of the components with the target amount of each of the components;

applying the sample coating composition to a test panel substrate and curing the sample coating composition to form a sample coating;

comparing characteristics of the sample coating with characteristics of a coating produced from the target formulation to determine whether there is an acceptable match of such characteristics;

characterizing the sample coating as passing or failing based upon the comparison of the characteristics of the sample coating and the coating produced from the target formulation; and correlating any differences between the characteristics of the sample coating and the coating produced from the target formulation with the comparison between the measured amount of each of the components and the target amount of each of the components to thereby determine whether, if the sample coating is characterized as failing, changes in the amounts of the components of the sample coating are necessary to match the characteristics of the sample coating to the coating produced from the target formulation;

monitoring at least one processing parameter when the sample coating composition is applied to the substrate or cured;

correlating any differences between the characteristics of the sample coating and the coating produced from the target formulation with the at least one monitored processing parameter; and applying indicia to the sample coating after the sample coating is formed, applying indicia to the sample coating after the at least one processing parameter is monitored, and/or applying indicia to the sample coating after the characteristics of the sample coating are determined, wherein the indicia corresponds to the measured amount of each of the components, the characteristics of the sample coating, the monitored processing parameter, or a combination thereof.

2. The method of claim 1, further comprising adding a reducer comprising water and/or an organic solvent to the components of the sample coating composition before the coating composition is applied to the substrate.

3. The method of claim 2, further comprising measuring the amount of the reducer, and comparing the measured amount of the reducer with a target amount of the reducer.

4. The method of claim 1, further comprising adding an additional amount of at least one of the components to the sample coating composition after the step of comparing the measured and target amounts of each of the components.

5. The method of claim 1, wherein the characteristics of the sample coating include color characteristics, spectral characteristics, appearance characteristics, physical property characteristics, or a combination thereof.

6. The method of claim 1, wherein the characteristics of the sample coating and the coating produced from the target formulation include color characteristics.

7. The method of claim 1, wherein upon characterizing the sample coating as failing, performing steps of:

altering the target formulation for the coating composition by adjusting an amount of at least one of the components of the coating composition to provide an adjusted coating composition;

automatically dispensing the components of the adjusted coating composition into another container and measuring the amount of each of the components of the adjusted coating composition dispensed into the other container;

comparing the measured amount of each of the components with the altered target amount of each of the components;

applying the adjusted coating composition to a substrate and curing the adjusted coating composition to form an adjusted sample coating;

comparing characteristics of the adjusted sample coating with characteristics of an adjusted coating produced from the adjusted target coating formulation; and correlating any differences between the characteristics of the adjusted sample coating and the adjusted coating produced from the adjusted target coating formulation with the comparison between the measured amount of each of the components and the target amount of each of the components of the adjusted coating composition.

8. The method of claim 1, further comprising applying indicia to the sample coating after the sample coating is formed, wherein the indicia corresponds to the measured amount of each of the components, the characteristics of the sample coating, or a combination thereof.

9. The method of claim 1, wherein the at least one monitored processing parameter comprises pressure level, delivery rate, or a combination thereof.

10. The method of claim 1, wherein the at least one monitored processing parameter comprises flash time, cure time, or a combination thereof.

11. The method of claim 1, wherein the coating composition is an auto refinish coating composition.

12. The method of claim 1, wherein the coating composition is an architectural coating.

* * * * *